US010508479B2

(12) United States Patent
Hwang et al.

(10) Patent No.: US 10,508,479 B2
(45) Date of Patent: Dec. 17, 2019

(54) HOOD LATCH ASSEMBLY FOR VEHICLE

(71) Applicant: Hyundai Motor Company, Seoul (KR)

(72) Inventors: In Hwang, Hwaseong-si (KR); So Yeon Park, Seoul (KR); Byung Joo Lee, Seoul (KR); Ki Won Kim, Hwaseong-si (KR); Byoung Haan Choi, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 330 days.

(21) Appl. No.: 15/481,161

(22) Filed: Apr. 6, 2017

(65) Prior Publication Data

US 2018/0142504 A1 May 24, 2018

(30) Foreign Application Priority Data

Nov. 24, 2016 (KR) ..... 10-2016-0157622

(51) Int. Cl.

| | |
|---|---|
| ***E05B 83/24*** | (2014.01) |
| ***E05B 79/16*** | (2014.01) |
| ***E05B 85/20*** | (2014.01) |
| ***E05B 85/24*** | (2014.01) |

(52) U.S. Cl.

CPC ..... *E05B 83/24* (2013.01); *E05B 79/16* (2013.01); *E05B 83/243* (2013.01); *E05B 85/20* (2013.01); *E05B 85/243* (2013.01)

(58) Field of Classification Search

CPC ..... E05B 83/24; E05B 83/16; E05B 83/243; Y10S 292/14; Y10S 292/43

See application file for complete search history.

(56) References Cited

U.S. PATENT DOCUMENTS

| | | | | |
|---|---|---|---|---|
| 6,422,616 | B1 * | 7/2002 | Wortmann | E05B 83/24 292/214 |
| 6,435,574 | B1 * | 8/2002 | Taga | E05B 83/16 292/216 |
| 9,027,971 | B2 * | 5/2015 | Barczynski | E05B 83/24 292/100 |
| 2011/0025077 | A1 * | 2/2011 | Meyer | E05B 83/16 292/216 |

(Continued)

FOREIGN PATENT DOCUMENTS

| | | |
|---|---|---|
| JP | 4040857 B2 | 1/2008 |
| JP | 5108691 B2 | 12/2012 |

(Continued)

*Primary Examiner* — Mark A Williams

(74) *Attorney, Agent, or Firm* — Slater Matsil, LLP

(57) ABSTRACT

A hood latch assembly for a vehicle. A housing includes an insert recess allowing a striker coupled to a hood of a vehicle to be retracted into and withdrawn from the insert recess. A latch has one end portion pivotably coupled to an inner portion of the housing. A fitting recess in the other end portion of the latch allows the striker to be retracted into and withdrawn from the fitting recess. A support protrusion is formed on one end portion of the fitting recess. A safety hook includes a hinge disposed on one end portion to be pivotably coupled to an outer portion of housing and a sliding protrusion disposed on the other end portion to allow the striker to slide when in contact with the striker. When the hood is in a closed position, the safety hook is supported by the support protrusion so as not to pivot.

16 Claims, 6 Drawing Sheets

(56) References Cited

U.S. PATENT DOCUMENTS

| | | | | |
|---|---|---|---|---|
| 2012/0074715 | A1* | 3/2012 | Kim | B60R 21/34 292/201 |
| 2014/0015258 | A1 | 1/2014 | Barczynski et al. | |
| 2014/0054903 | A1* | 2/2014 | Kim | E05B 83/24 292/96 |
| 2014/0062098 | A1* | 3/2014 | Kim | E05B 83/24 292/28 |
| 2014/0138961 | A1* | 5/2014 | Hwang | E05B 83/24 292/122 |
| 2015/0115625 | A1 | 4/2015 | Park et al. | |
| 2015/0345187 | A1* | 12/2015 | Kwon | E05B 83/24 292/44 |
| 2016/0186471 | A1 | 6/2016 | Cho et al. | |

FOREIGN PATENT DOCUMENTS

| | | | |
|---|---|---|---|
| JP | 5514357 | B1 | 6/2014 |
| KR | 1019990018610 | A | 3/1999 |
| KR | 100520966 | B1 | 10/2005 |
| KR | 20140052102 | A | 5/2014 |
| KR | 20150049739 | A | 5/2015 |
| KR | 101595331 | B1 | 2/2016 |
| KR | 20160034506 | A | 3/2016 |
| KR | 101662900 | B1 | 10/2016 |
| KR | 101673721 | B1 | 11/2016 |

* cited by examiner

HOOD LATCH ASSEMBLY FOR VEHICLE

CROSS-REFERENCE TO RELATED APPLICATIONS

The present application claims priority to Korean Patent Application No. 10-2016-0157622, filed Nov. 24, 2016, the entire contents of which is incorporated herein for all purposes by this reference.

TECHNICAL FIELD

The present application relates to vehicles and in particular to a hood latch assembly for a vehicle.

BACKGROUND

Typically, a vehicle includes an engine room disposed in the front part thereof and a hood disposed above the engine room. The hood is configured to be opened and closed such that the engine room can be accessed. The hood also serves to protect the engine room while blocking noise generated by the engine.

In the hood as described above, a predetermined edge is hinge-coupled to the vehicle body, while the opposite edge is provided with a hood latch assembly allowing the hood to be locked to the vehicle body. A user can open or close the hood using the hood latch assembly.

The hood latch assembly is a device for opening and closing the hood. The hood latch assembly has a double locking structure to prevent the hood from being accidently opened. This structure can also hold the hood in the closed position in a situation in which the hood needs to be closed. In a situation in which the hood needs to be opened, the user operates the hood to pop up using a button in the cab and then manipulates a lever by inserting his/her hand between the hood that is popped up and the vehicle body to open the hood.

Such levers are categorized into integrated-lever latches and separate-lever latches. In the case of integrated-lever latches, a lever is elongated. Thus, the lever has drawbacks, such as a relatively lower level of strength and a relatively larger lever gap. In addition, a negative shape of the lever needs to be added to the hood inner panel in order to prevent the hood inner panel from being interfered by the lever. Furthermore, the lever may injure pedestrians and may degrade the aesthetic appearance of the hood panel. Second, separate-lever latches may increase the height of the hood from the ground, thereby increasing the possibility of damaging the head of the user. Since a relatively short person may feel find it difficult to close the hood, the operability of the hood may be reduced.

The foregoing is intended merely to aid in the understanding of the background of the present invention, and is not intended to mean that the present invention falls within the purview of the related art that is already known to those skilled in the art.

SUMMARY

Accordingly, embodiments of the present invention have been made keeping in mind the above problems occurring in the related art, and embodiments of the present invention are intended to propose a hood lever assembly for a vehicle, the hood lever assembly having a simple configuration and being able to be easily manipulated, protect a user and pedestrians, and increase the operability and aesthetic appearance thereof.

In order to achieve the above object, according to one aspect of the present invention, a hood latch assembly for a vehicle may include: a housing having an insert recess allowing a striker coupled to a hood of a vehicle to be retracted into and withdrawn from the insert recess; a latch, with one end portion thereof being pivotably coupled to an inner portion of the housing, the latch having a fitting recess in the other end portion, the fitting recess allowing the striker to be retracted into and withdrawn from the fitting recess, and a support protrusion formed on one end portion of the fitting recess; and a safety hook having a hinge disposed on one end portion to be pivotably coupled to an outer portion of housing and a sliding protrusion disposed on the other end portion, the sliding protrusion allowing the striker to slide when in contact with the striker, wherein, when the hood closed, the safety hook is supported by the support protrusion such that the safety hook does not pivot.

The latch may pivot in response to the hood being popped up, causing the support protrusion 430 to be detached from the safety hook, so that the safety hook pivots in a transverse direction of the vehicle, thereby being supported by the striker.

In a position in which the hood is completely opened, the safety hook may be pivoted by the hinge to come into close contact with an outer surface of the housing.

The safety hook may be a plate-shaped bar that is configured such that, when the hood is closed, relatively wider surfaces thereof are oriented in a transverse direction of the vehicle to increase an area of the support protrusion of the latch in contact with the safety hook, thereby effectively preventing the safety hook from pivoting.

The sliding protrusion may extend away from the housing at a predetermined angle to form a slope, along which the striker slides to enter the insert recess when the hood is closed.

The hood latch assembly may further include: an auxiliary latch supporting the latch; and a first resilient member with one end portion thereof being coupled to the housing and the other end portion thereof being coupled to the auxiliary latch, the first resilient member allowing the auxiliary latch to resiliently restore an original position thereof after pivoting.

The hood latch assembly may further include a second resilient member with one end portion thereof being coupled to the housing and the other end portion thereof being coupled to the safety hook, the second resilient member allowing the safety hook and the hinge to resiliently pivot.

The hood latch assembly may further include a third resilient member with one end portion thereof being coupled to the housing and the other end portion thereof being coupled to the latch, the third resilient member allowing the latch to resiliently pivot.

The support protrusion may be located on a lower end portion of the fitting recess, extend in a rearward direction of the vehicle, and move within the insert recess in response to pivoting of the latch, thereby preventing the safety hook from pivoting.

According to the hood latch assembly for a vehicle having the above-described configuration, the configuration is simple and the operability thereof is easy, since an actuator and a lever can be omitted. In addition, the hood latch assembly can safely protect a user and pedestrians, improve the degree of freedom of the design thereof, and improve the operability and aesthetic appearance thereof.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF ILLUSTRATIVE EMBODIMENTS

Figure 1:
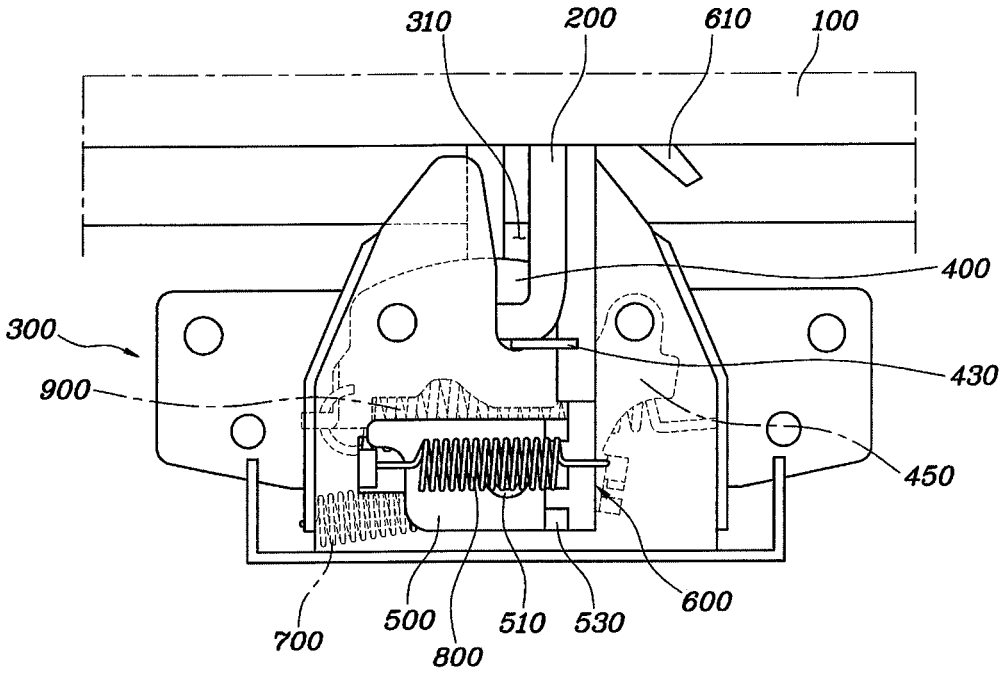
FIG. 1 illustrates a hood latch assembly according to an exemplary embodiment of the present invention, in which a hood is closed.

The present invention generally relates to a hood latch assembly disposed in the front part of a vehicle. More particularly, embodiments of the present invention relates to a hood latch assembly for a vehicle able to protect a user and increase the strength thereof by removing a lever from the hood latch assembly.

Hereinafter, a hood latch assembly according to exemplary embodiments of the present invention will be described in detail with reference to the accompanying drawings. Throughout the drawings, the same reference numerals will refer to the same or like parts.

Figure 2:
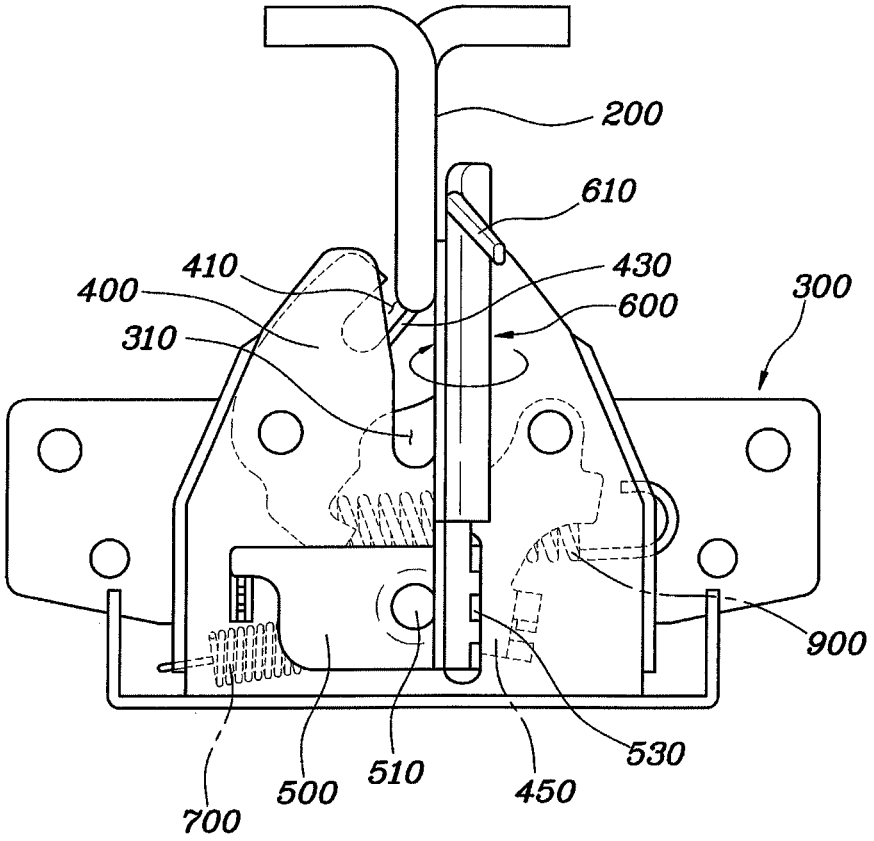
FIG. 2 illustrates the hood latch assembly illustrated in FIG. 1, in which the hood is popped up.
Figure 3:
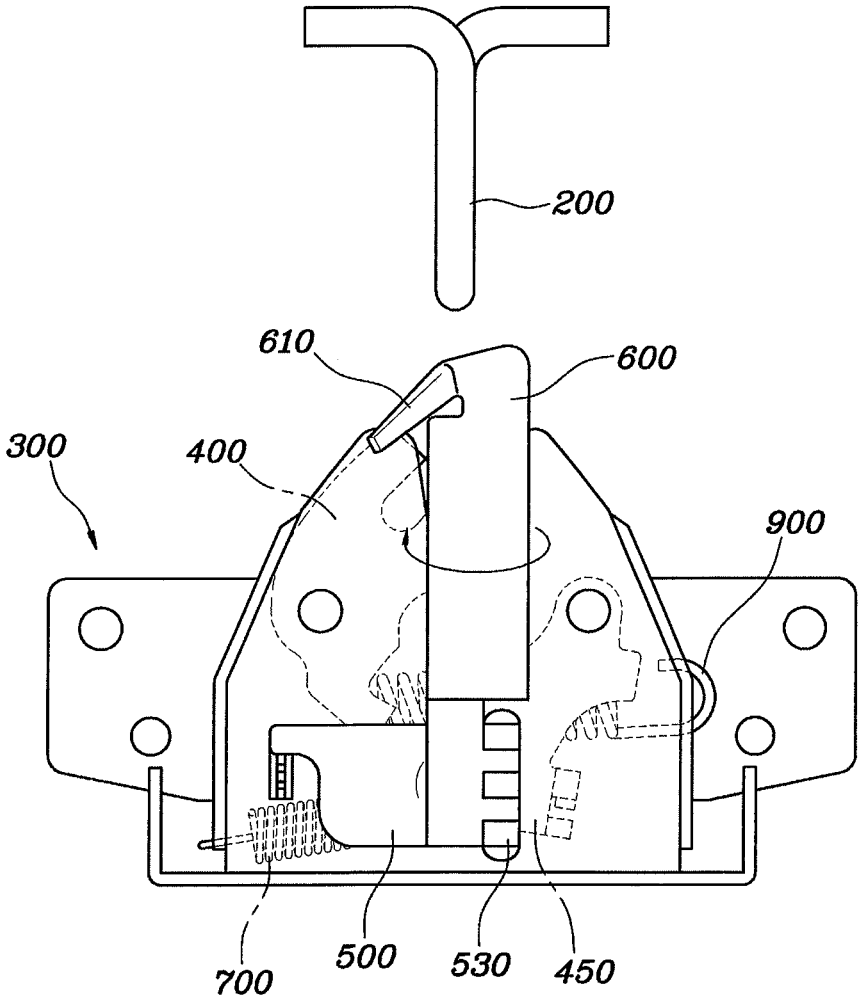
FIG. 3 illustrates the hood latch assembly illustrated in FIG. 1, in which the hood is completely opened.
Figure 4:
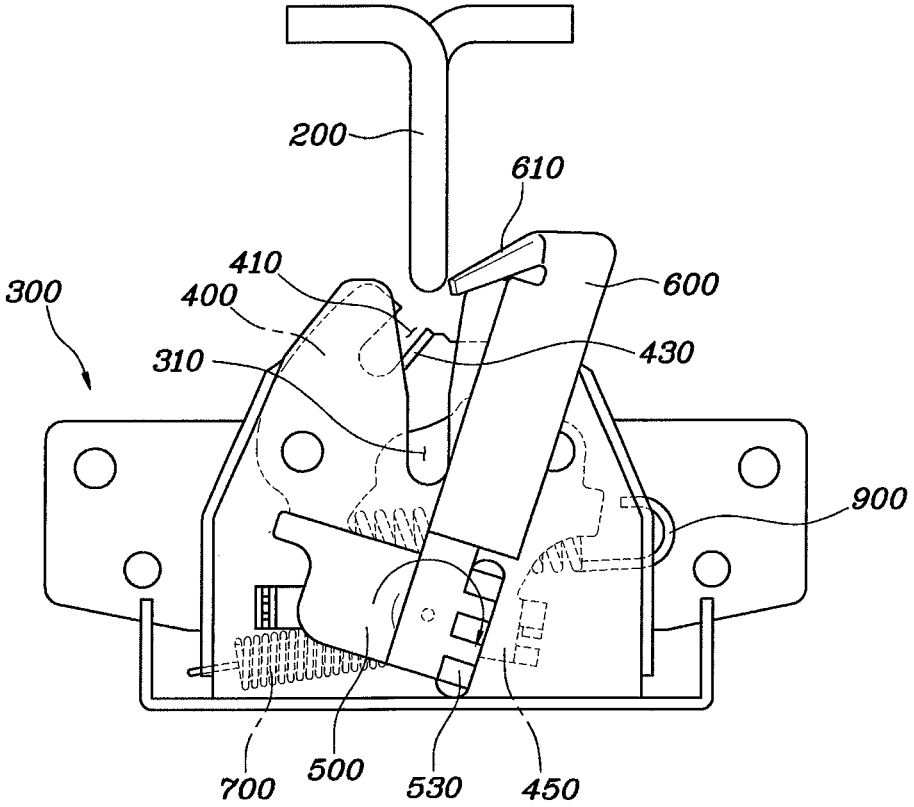
FIGS. 4 and 5 illustrate the hood latch assembly illustrated in FIG. 1, in which the hood is closed.
Figure 5:
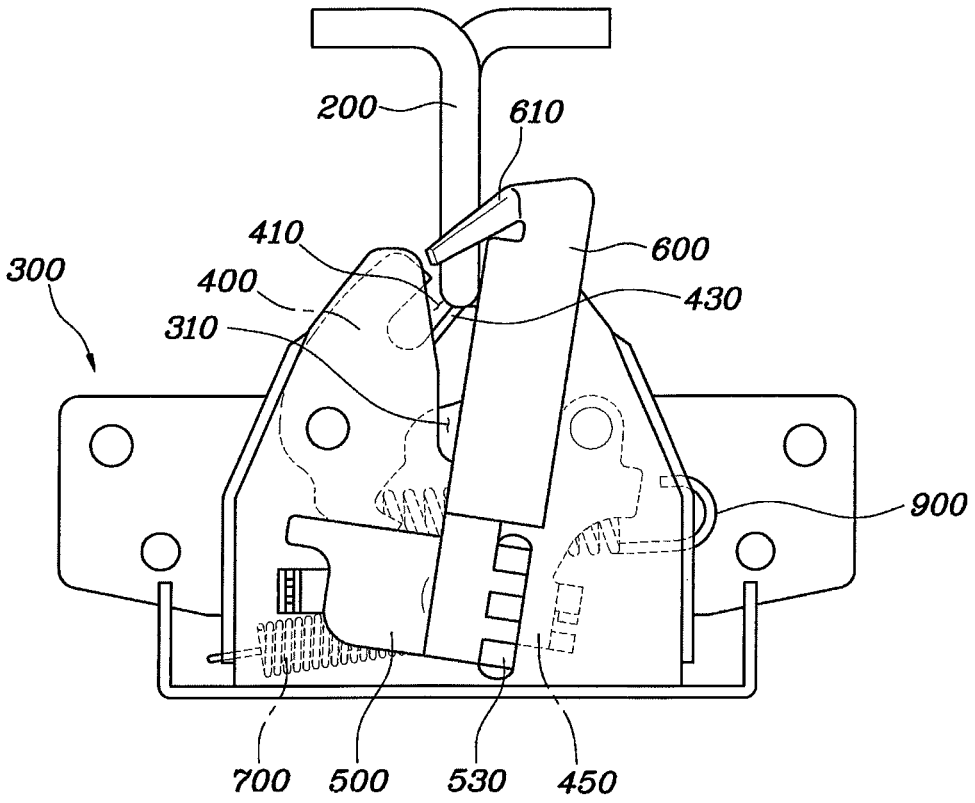
Figure 6:
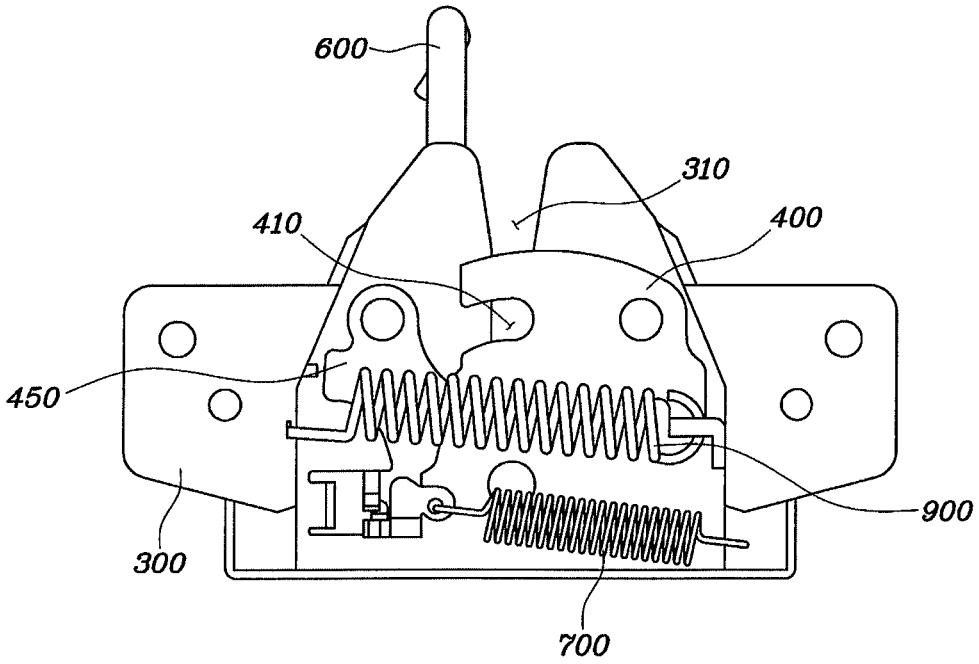
FIG. 6 illustrates a rear side of the hood latch assembly illustrated in FIG. 1.

FIG. 1 illustrates a hood latch assembly according to an exemplary embodiment of the present invention in which a hood 100 of a vehicle is closed, FIG. 2 illustrates the hood latch assembly illustrated in FIG. 1, in which the hood 100 is popped up, FIG. 3 illustrates the hood latch assembly illustrated in FIG. 1, in which the hood 100 is completely opened, FIGS. 4 and 5 illustrate the hood latch assembly illustrated in FIG. 1, in which the hood 100 is closed, and FIG. 6 illustrates a rear side of the hood latch assembly illustrated in FIG. 1.

The hood latch assembly for a vehicle according to the exemplary embodiment of the present invention includes a housing 300, a latch 400, and a safety hook 600. The housing 300 has an insert recess 310 allowing a striker 200 coupled to the hood 100 of the vehicle to be retracted into and withdrawn from the insert recess 310. One end portion of the latch 400 is pivotably coupled to an inner portion of the housing 300. The latch 400 has a fitting recess 410 in the other end portion such that the striker 200 can be retracted into and withdrawn from the fitting recess 410. A support protrusion 430 is formed on one end portion of the fitting recess 410. The safety hook 600 has a hinge 500 disposed on one end portion to be pivotably coupled to an outer portion of the housing 300 and a sliding protrusion 610 disposed on the other end portion. The sliding protrusion 610 allows the striker 200 to slide when in contact with the striker 200. When the hood 100 is closed, the safety hook 600 is supported by the support protrusion 430 such that safety hook 600 does not pivot.

The striker 200 is disposed on the hood 100 in the downward direction of the vehicle. The hood latch assembly is disposed on the vehicle, in front of the engine room of the vehicle that faces the striker 200, such that the hood latch assembly locks and unlocks the striker 200.

The housing 300 is disposed on the vehicle body. The housing 300 has the insert recess 310 such that the striker 200 is retracted into and withdrawn from the insert recess 310.

One end portion of the latch 400 is pivotably coupled to the inner portion of the housing 300. The latch 400 remains in a position in which the latch 400 is prevented from pivoting by an auxiliary latch 450 that is pivoted by a wire (not shown). A first resilient member 700 is provided on the auxiliary latch 450. One end portion of the first resilient member 700 is coupled to the housing 300, and the other end portion of the first resilient member 700 is coupled to the auxiliary latch 450. The first resilient member 700 allows the auxiliary latch 450 to resiliently restore the original position after pivoting.

In addition, the latch 400 has the fitting recess 410 allowing the striker 200 to be retracted into and withdrawn from the striker 200. The support protrusion 430 formed on one end portion of the fitting recess 410 extends in the rearward direction of the vehicle. In particular, the support protrusion 430 is located on the lower end portion of the fitting recess 410. The support protrusion 430 is located adjacent to the insert recess 310 to move within the insert recess 310 in response to pivoting of the latch 400, thereby preventing the safety hook 600 from pivoting or allowing the safety hook 600 to pivot. In particular, a third resilient member 900 is provided on the latch 400. One end portion of the first resilient member 700 is coupled to the housing 300, and the other end portion of the first resilient member 700 is coupled to the latch 400. The third resilient member 900 allows the latch 400 to resiliently pivot.

As illustrated in the drawings, the safety hook 600 may be a plate-shaped bar. Thus, the safety hook 600 is comprised of relatively wider surfaces and relatively narrower surfaces distinguished from the relatively wider surfaces. The safety hook 600 is configured such that the relatively wider surfaces are oriented in the transverse direction of the vehicle when the hood 100 is closed. This can consequently increase the area of the support protrusion 430 of the latch 400 to be in contact with the safety hook 600, thereby effectively preventing the safety hook 600 from pivoting.

In addition, the latch 400 pivots in response to the hood 100 being popped up, causing the support protrusion 430 to detached from the safety hook 600, so that the safety hook 600 pivots in the transverse direction of the vehicle, thereby overlapping and being supported by the striker 200. Afterwards, in a position in which the hood 100 is completely opened, the safety hook 600 is pivoted by the hinge 500 to come into close contact with the outer surface of the housing 300. In particular, a second resilient member 800 is provided on the safety hook 600. One end portion of the second resilient member 800 is coupled to the housing 300, and the other end portion of the second resilient member 800 is coupled to the safety hook 600. The second resilient member 800 allows the safety hook 600 to resiliently pivot.

The sliding protrusion 610 is provided on the safety hook 600. The sliding protrusion 610 extends away from the housing 300 at a predetermined angle, thereby forming a slope. With this configuration, the sliding protrusion 610 guides the striker 200 to slide along the slope of the sliding protrusion 610 to enter the insert recess 310 when the hood 100 is closed. The hinge 500 is also resiliently restored by the second resilient member 800 after pivoting.

The operation of the hood latch assembly according to the exemplary embodiment of the present invention will be described in detail with reference to the drawings.

When the hood 100 is closed, as illustrated in FIG. 1, the striker 200 is retracted into the insert recess 310 and the fitting recess 410 and then remains in a double-locked position. Here, the relatively wider surfaces of the safety hook 600 are oriented in the transverse direction of the vehicle, and resilient force is applied in the direction in which the second resilient member 800 is compressed. In contrast, the safety protrusion is supported by the support protrusion 430 so that the pivoting thereof is being prevented.

FIG. 2 illustrates a case in which a user has manipulated an open switch (not shown) disposed in the cabin of the vehicle to open the hood 100. When the user manipulates the open switch, the open switch draws a wire (not shown) connected to the auxiliary latch 450. The auxiliary latch 450 is pivoted by the first resilient member 700, and the latch 400 engaged with the auxiliary latch 450 is pivoted by the resilient force of the third resilient member 900, thereby causing the hood 100 to pop up. Thus, the striker 200 is displaced upwards by a distance equal to a distance by which the hood 100 is popped up by the pivoting of the latch 400, thereby being dislodged from the fitting recess 410 and the insert recess 310. Consequently, the safety hook 600 is detached from the support protrusion 430 and is pivoted to a predetermined angle by the resilient force of the second resilient member 800. However, the upper end portion of the safety hook 600 is supported by the striker 200, thereby preventing the safety hook 600 from pivoting by a greater angle.

FIG. 3 illustrates a position in which the hood 100 is completely opened. When the user opens the hood 100 upwards with his/her hand, the striker 200 is completely detached from the insert recess 310 and the fitting recess 410. Here, the latch 400 is completely pivoted by the third resilient member 900, and the safety hook 600 is detached from the striker 200 that prevented the safety hook 600 from pivoting. Then, the resilient force of the second resilient member 800 drives the safety hook 600 to completely pivot about the hinge 500, so that the safety hook 600 remains in contact with and supported by the outer surface of the housing 300.

The process of closing the hood 100, in which the user presses the hood 100 downwards to close the hood 100, is illustrated in FIGS. 4 and 5. When the hood 100 is closed, the striker 200 is displaced downwards to enter the insert recess 310. Here, the striker 200 comes into contact with the sliding protrusion 610 of the safety hook 600, the striker 200 slides toward the insert recess 310 along the slope of the sliding protrusion 610, and the safety hook 600 and the hinge 500 pivot about a pivot shaft 510 of the hinge 500. Since the fitting recess 410 of the latch 400 is opened toward the striker 200, the striker 200 is retracted into the fitting recess 410 to press the latch 400 downwards, so that the latch 400 pivots in the closing direction by overcoming the resilient force of the third resilient member 900. The safety hook 600 and the hinge 500 are pivoted by the second resilient member 800 to restore the original positions, and the support protrusion 430 allows the safety hook 600 to pivot about a hinge shaft 530 and attain a supported position, so that the hood 100 can remain in the closed position (i.e. the position illustrated in FIG. 1).

Accordingly, the hood latch assembly for a vehicle as described above has advantages, such as a simple configuration and easy operability, since an actuator and a lever can be omitted. In addition, the hood latch assembly can safely protect a user and pedestrians, improve the degree of freedom of the design thereof, and improve the operability and aesthetic appearance thereof.

Although a preferred embodiment of the present invention has been described for illustrative purposes, those skilled in the art will appreciate that various modifications, additions and substitutions are possible, without departing from the scope and spirit of the present invention as disclosed in the accompanying claims.

What is claimed is:

1. A hood latch assembly for a vehicle, the hood latch assembly comprising:

a housing comprising an insert recess, the housing configured to allow a striker coupled to a hood of the vehicle to be retracted into and withdrawn from the insert recess;

a latch, with one end portion thereof being pivotably coupled to an inner side portion of the housing, the latch comprising a fitting recess in other end portion thereof, the fitting recess configured to allow the striker to be retracted into and withdrawn from the fitting recess, and a support protrusion formed on one end portion of the fitting recess; and a safety hook comprising a hinge disposed on one end portion of the safety hook and configured to be pivotably coupled to an outer side portion of the housing and a sliding protrusion disposed on other end portion of the safety hook, the sliding protrusion configured to allow the striker to slide when in contact with the striker, wherein, when the hood of the vehicle is in a closed position, the safety hook is supported by the support protrusion such that the safety hook is not pivoted, wherein, in response to the hood being popped up, the latch is configured to pivot so as to detach the support protrusion from the safety hook, wherein action of the detaching allows to cause the safety hook to pivot in a left and right direction of the vehicle and be in contact with the striker, and wherein the sliding protrusion extends away from the housing at a predetermined angle to form a slope, along which the striker slides to enter the insert recess when the hood is closed.

2. The hood latch assembly of claim 1, wherein, in a position in which the hood is completely opened, the safety hook is pivoted by the hinge to come into close contact with an outer surface of the housing.

3. The hood latch assembly of claim 1, wherein the safety hook comprises a plate-shaped bar that is configured such that, when the hood is closed, relatively wider surfaces thereof are oriented in a transverse direction of the vehicle to increase an area of the support protrusion of the latch in contact with the safety hook, thereby effectively preventing the safety hook from pivoting.

4. The hood latch assembly of claim 1, further comprising:

an auxiliary latch supporting the latch; and a first resilient member with one end portion thereof being coupled to the housing and other end portion thereof being coupled to the auxiliary latch, the first resilient member allowing the auxiliary latch to resiliently restore an original position thereof after pivoting.

5. The hood latch assembly of claim 1, further comprising a second resilient member with one end portion thereof being coupled to the housing and other end portion thereof being coupled to the safety hook, the second resilient member allowing the safety hook and the hinge to resiliently pivot.

6. The hood latch assembly of claim 1, further comprising a third resilient member with one end portion thereof being coupled to the housing and other end portion thereof being coupled to the latch, the third resilient member allowing the latch to resiliently pivot.

7. The hood latch assembly of claim 1, wherein the support protrusion is located on a lower end portion of the fitting recess, extends in a rearward direction of the vehicle, and moves within the insert recess in response to pivoting of the latch, thereby preventing the safety hook from pivoting.

8. A hood latch assembly for a vehicle, the hood latch assembly comprising:

a housing comprising an insert recess, the housing configured to allow a striker coupled to a hood of the vehicle to be retracted into and withdrawn from the housing;

a latch, with one end portion thereof being pivotably coupled to an inner side portion of the housing, the latch comprising a fitting recess in other end portion thereof, the fitting recess configured to allow the striker to be retracted into and withdrawn from the fitting recess, and a support protrusion disposed on an end portion of the fitting recess; and a safety hook comprising a hinge disposed on an end portion of the safety hook and configured to be pivotably coupled to an outer side portion of the housing, and a sliding protrusion disposed on other end portion of the safety hook, the sliding protrusion configured to allow the striker to slide when in contact with the striker, wherein, when the hood of the vehicle is in a closed position, the safety hook is configured to be supported by the support protrusion to prevent the safety hook from pivoting, wherein, in response to the hood being in a popped up position, the latch is configured to pivot so as to detach the support protrusion from the safety hook, wherein action of the detaching allows to cause the safety hook to pivot in a left and right direction of the vehicle and be in contact with the striker, and wherein the sliding protrusion extends away from the housing at a predetermined angle to form a slope, along which the striker slides to enter the insert recess when the hood is closed.

9. The hood latch assembly of claim 8, wherein, in a position in which the hood is completely opened, the safety hook is pivoted by the hinge to come into close contact with an outer surface of the housing.

10. The hood latch assembly of claim 8, wherein the safety hook comprises a plate-shaped bar that is configured such that, when the hood is in the closed position, relatively wider surfaces thereof are oriented in a transverse direction of the vehicle to increase an area of the support protrusion of the latch in contact with the safety hook, wherein the increase in the area of the support protrusion is configured to effectively prevent the safety hook from pivoting.

11. The hood latch assembly of claim 8, further comprising:

an auxiliary latch supporting the latch; and a first resilient member with one end portion thereof being coupled to the housing and other end portion thereof being coupled to the auxiliary latch, the first resilient member allowing the auxiliary latch to resiliently restore an original position thereof after pivoting.

12. The hood latch assembly of claim 8, further comprising a second resilient member with one end portion thereof being coupled to the housing and other end portion thereof being coupled to the safety hook, the second resilient member allowing the safety hook and the hinge to resiliently pivot.

13. The hood latch assembly of claim 8, further comprising a third resilient member with one end portion thereof being coupled to the housing and other end portion thereof being coupled to the latch, the third resilient member allowing the latch to resiliently pivot.

14. A hood latch assembly for a vehicle, the hood latch assembly comprising:

a housing comprising an insert recess, the housing configured to allow a striker coupled to a hood of the vehicle to be retracted into and withdrawn from the housing;

a latch, with one end portion thereof being pivotably coupled to an inner side portion of the housing, the latch comprising a fitting recess in other end portion thereof, the fitting recess configured to allow the striker to be retracted into and withdrawn from the fitting recess, and a support protrusion disposed on an end portion of the fitting recess; and a safety hook comprising a hinge disposed on an end portion of the safety hook and configured to be pivotably coupled to an outer side portion of the housing, and a sliding protrusion disposed on other end portion of the safety hook, the sliding protrusion configured to allow the striker to slide when in contact with the striker, wherein, when the hood of the vehicle is in a closed position, the safety hook is configured to be supported by the support protrusion to prevent the safety hook from pivoting, wherein, in response to the hood being in a popped up position, the latch is configured to pivot so as to detach the support protrusion from the safety hook, wherein action of the detaching allows to cause the safety hook to pivot in a left and right direction of the vehicle and be in contact with the striker, and wherein the sliding protrusion extends away from the housing at a predetermined angle to form a slope, along which the striker slides to enter the insert recess when the hood is closed, wherein the support protrusion is located on a lower end portion of the fitting recess, extends in a rearward direction of the vehicle, and moves within the insert recess in response to pivoting of the latch, thereby preventing the safety hook from pivoting.

15. The hood latch assembly of claim 14, wherein, in a position in which the hood is completely opened, the safety hook is pivoted by the hinge to come into close contact with an outer surface of the housing.

16. The hood latch assembly of claim 14, wherein the safety hook comprises a plate-shaped bar that is configured such that, when the hood is in the closed position, relatively wider surfaces thereof are oriented in a transverse direction of the vehicle to increase an area of the support protrusion of the latch in contact with the safety hook, wherein the increase in the area of the support protrusion is configured to effectively prevent the safety hook from pivoting.

* * * * *